US006116167A

United States Patent [19]

Rabe

[11] Patent Number: 6,116,167

[45] Date of Patent: Sep. 12, 2000

[54] COVERING FOR A TABLE TOP

[75] Inventor: Jürgen Rabe, Höchstadt, Germany

[73] Assignee: PiK Partner in Kunststoff, Hochstadt, Germany

[21] Appl. No.: 08/894,789

[22] PCT Filed: Mar. 3, 1996

[86] PCT No.: PCT/DE96/00362

§ 371 Date: Dec. 22, 1997

§ 102(e) Date: Dec. 22, 1997

[87] PCT Pub. No.: WO96/27311

PCT Pub. Date: Sep. 12, 1996

[30] Foreign Application Priority Data

Mar. 8, 1995 [DE] Germany ..... 195 07 871

[51] Int. Cl.[7] ..... A47B 13/08

[52] U.S. Cl. ..... 108/90; 108/27; 150/158

[58] Field of Search ..... 108/90, 27; 150/158

[56] References Cited

U.S. PATENT DOCUMENTS

| | | | |
|---|---|---|---|
| 1,916,435 | 7/1933 | Ott et al. | 108/90 |
| 2,954,635 | 10/1960 | Stotter | 108/90 X |
| 3,729,037 | 4/1973 | Dare et al. | 108/90 X |
| 3,825,050 | 7/1974 | Glover | 150/158 |
| 4,627,363 | 12/1986 | Jones | 108/90 |
| 4,705,084 | 11/1987 | Rodebaugh et al. | 108/90 X |
| 4,744,309 | 5/1988 | Kiesel et al. | 108/27 X |
| 4,750,402 | 6/1988 | Markey | 108/90 X |
| 4,777,992 | 10/1988 | Olger | 108/90 |
| 4,883,001 | 11/1989 | Roth . | |
| 5,084,321 | 1/1992 | Sui | 150/158 X |

FOREIGN PATENT DOCUMENTS

| | | | |
|---|---|---|---|
| 0 096 202 | 12/1983 | European Pat. Off. . | |
| 1478336 | 4/1967 | France | 108/90 |
| 25616 | 12/1904 | United Kingdom | 108/90 |

*Primary Examiner*—Peter M. Cuomo
*Assistant Examiner*—Hanh V. Tran
*Attorney, Agent, or Firm*—Nixon Peabody LLP; David S. Safran

[57] ABSTRACT

In order to cover a table top (7), it is proposed that a covering should be designed in the form of two mats (2, 3) connected along one side; these mats are fitted on the table top (7) in such a way that one mat (2) lies on the top surface (8) of the table and the other mat (3) lies on or is adjacent to the bottom surface (13) of the table and the covering is secured in that position. The top side of the top mat maybe made as an anti-slip covering (10) and/or be made transparent.

18 Claims, 2 Drawing Sheets

COVERING FOR A TABLE TOP

BACKGROUND OF THE INVENTION

Field of the Invention

This invention relates to a support or covering for a table having an advertising surface.

SUMMARY OF THE INVENTION

The object of this invention is to develop a table top support such that it is fixed on the table top or is joined to it by form-fit and that the material on the table does not slide off, if the table top for example tilts or other forces act on it which entail the danger of the material thereon sliding or slipping off.

This object is achieved by providing a support or covering for a table top including a top plate adapted to at least partially cover at least substantially 60% of an upper side of the table top, the top plate having an antislip outer surface for resisting slippage of articles placed thereon, and a bottom plate adapted to at least partially cover at least substantially 60% of a lower side of the table top, the bottom plate being pivotably mounted to the top plate and having an advertising outside surface for displaying of an advertisement.

Because the support surrounds the table top on two sides, it is protected against unintentionally falling down even in an inclined position. In addition, material on the table, such as glasses, cups, or the like, does not slip at an incline of for example up to 50° and therefore cannot fall off the table top either.

The support as claimed in the invention for a table top is therefore especially well suited for use in aircraft, ships, especially yachts, busses, or the like. As a result of the U-shape the support is especially well suited to folding tables as are used for example in aircraft, since they can be easily attached and removed. In addition, it does not require a large amount of storage space since it can be stacked in one plane and essentially moved into the U-shape only at the site where it will be used. When used on folding tables an advertising surface is visible when they are folded up, so that thus an additional benefit or cover in accordance with the present as claimed in the invention arises.

Other advantageous details of the invention are detailed below using the embodiments shown in the drawings.

BRIEF DESCRIPTION OF THE INVENTION

FIG. 1 shows a support consisting of a plate or film before folding,

FIG. 2 shows the support as shown in FIG. 1 after folding into a U-shape, FIG. 3 shows a section of a support with a closure, FIG. 4 shows a segment of one front edge of a table top, FIG. 5 shows a segment of the edge zone of a support on the front of a table top, FIGS. 6 and 7 show one view each of a bending zone, FIGS. 8*a* and *b* and 9*a* and *b* each show a cross section through a segment of a plate of the support in different embodiments.

FIG. 10 is a plan view of a portion of the bottom plate that is embossed braille characters and which is transparent, revealing advertising matter on its underside.

DETAILED DESCRIPTION OF THE DRAWINGS

Figure 1:
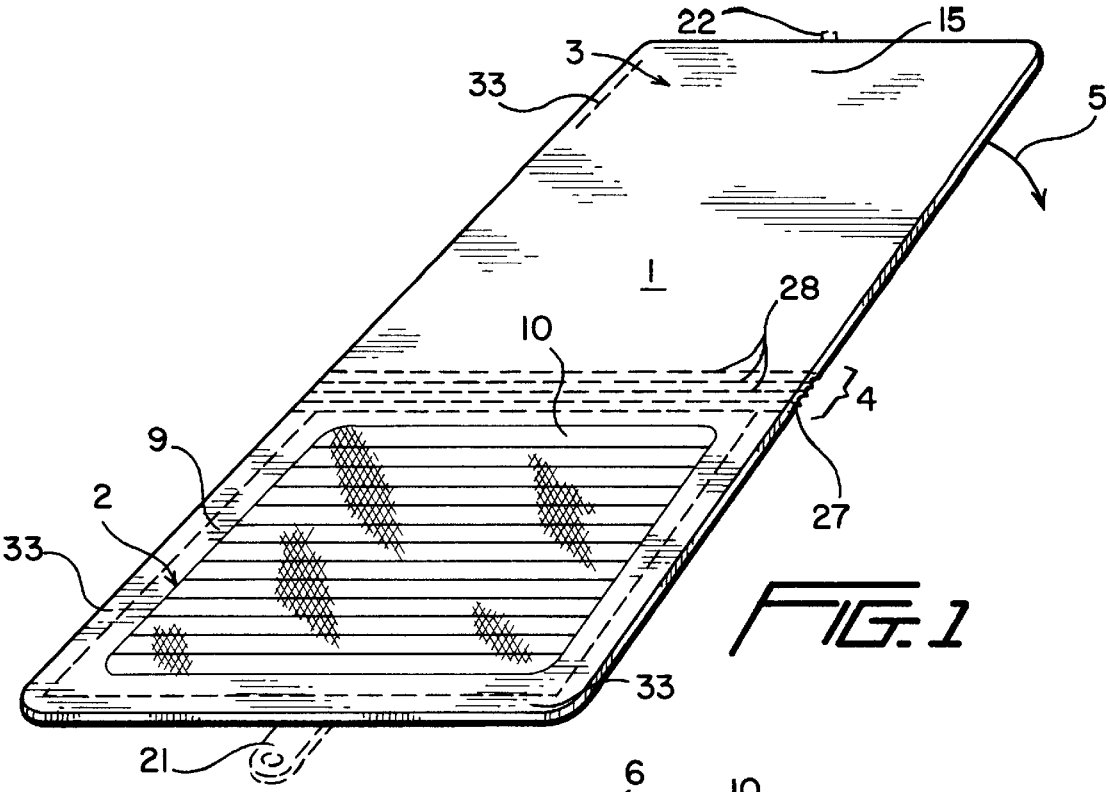
Figure 2:
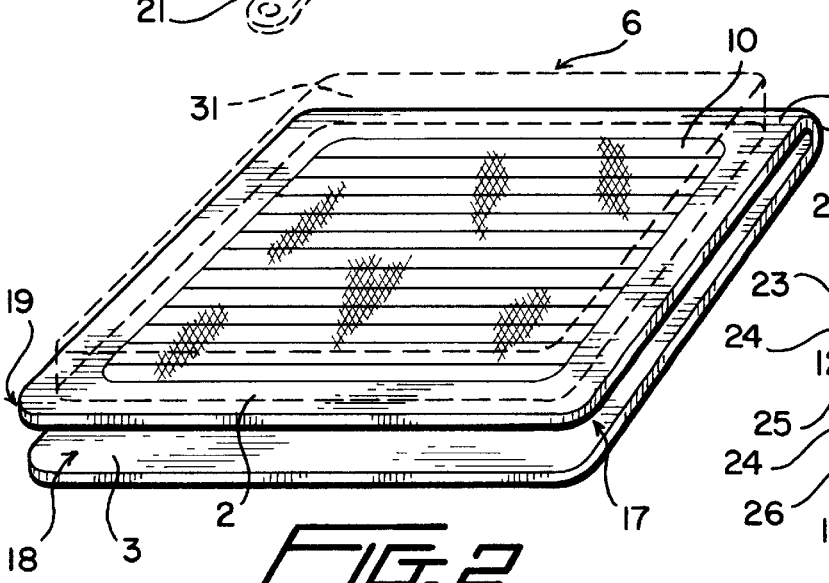

In FIG. 1 a deep-drawn film or deep-drawn plate of metal, paper or plastic is labeled 1; it has two plates 2 and 3 which stick together. Between plates 2, 3 there is a hinge or bending zone 4 around which plate 3 can be folded down for example in the direction of arrow 5. In this way a covering or support designated hereinafter as support 6 bent in a U-shape is formed, as is shown in FIG. 2. This support 6 can be attached to table top 7 by pushing it over the top and then by its covering table top 7 in its entirety or in part, for example up to 60% to 70%.

Figure 8A:
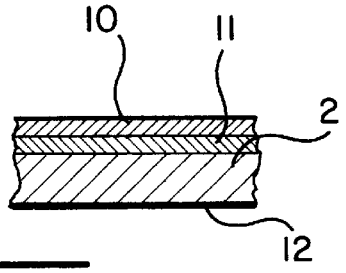
Figure 8B:
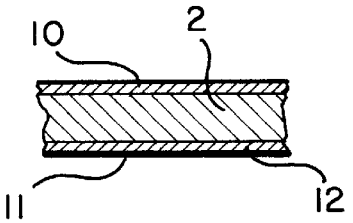
Figure 10:
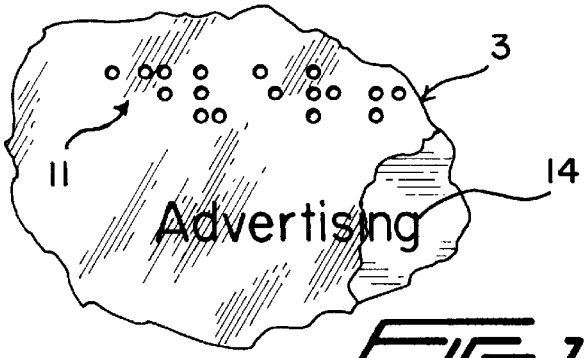

Plate 2 which lies on top 8 of table top 7 is made to be nonskid on outside surface 9, for example, it is provided with antislip coating 10. The material of plate 2 can also be made entirely of a material with antislip or slip-inhibiting properties. Antislip coating 10 is preferably made transparent. According to FIG. 8*a* under this antislip coating 10 information 11 is attached, for example in the form of a picture and/or text which has been cemented on or imprinted, such as a brochure, announcement, menu, or the like. When using plate 2 of transparent material information 11 can also be attached to back 12 of plate 2, as shown in FIG. 8*b*. Advertising 11 can also be embossed and can be felt from overhead so that the blind can also recognize the information (see FIG.10).

Figure 9A:
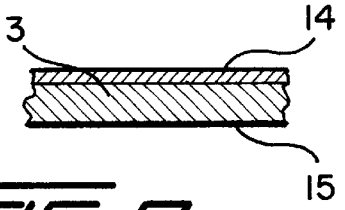
Figure 9B:
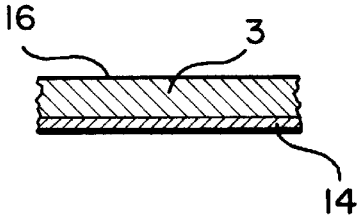

Plate 3 which lies on bottom 13 of table top 7 is made as an advertising surface and when attached to table top 7 carries information 14 on the side of plate 3 which forms outer side 15, as shown in FIG. 9*b*. When this plate 3 is made transparent, information 14 can also be provided selectively on inner side 16, as can be seen from FIG. 10 where the information 14, which the broken-away portion shows as being at the underside of bottom plate 3, is shown as being visible through the bottom plate. This information 14 is also visible in the folded-up state of a folding table.

Figure 3:
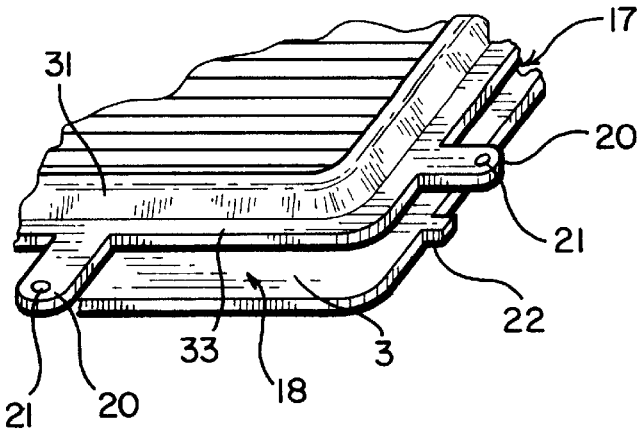

For purposes of attachment to table top 7 support 6 can also have at least on front side 17, 18, 19 which is open in the attached state a closure in the form of clip 20 attached to plate 2 or 3, with opening 21 and catch pin or catch button 22 attached to plate 2 or 3, as shown in FIG. 1 by a broken line and in the segment shown in FIG. 3 on two front sides 17 and 18. By bending clip 20 down by 90° catch button 22 engages opening 21 of clip 20. In this way plates 2 and 3 are held securely together and thus attached securely on table top 7.

Instead of closure 20, 22 or in addition to it, plates 2 and 3 on edge 23 can have retaining elements 24 which project towards the table top, preferably in the form of a peripheral low wall or one provided in sections. They are arranged such that when support 6 is attached to table top 7 they adjoin the front wall or front walls 25 of table top 7 with pretensioning and can hold support 6 by friction. On front walls 25 there can also be catch projections 26 which can engage wall sections 24 bent or arched to the inside.

Figure 6:
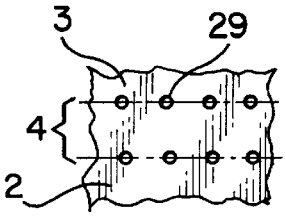
Figure 7:
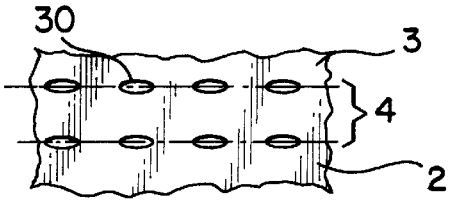

The bending zone or hinge 4 can be formed by a reduction of the cross section, for example by depressions 27 which run in the direction of bending lines 28 and which also can form an undulation, as FIG. 1 shows. Along bending lines 28 there can also be a perforation for example in the form of holes 29, longitudinal slots 30 or the like which are attached along these bending lines 28, as is illustrated using FIGS. 6 and 7.

Figure 5:
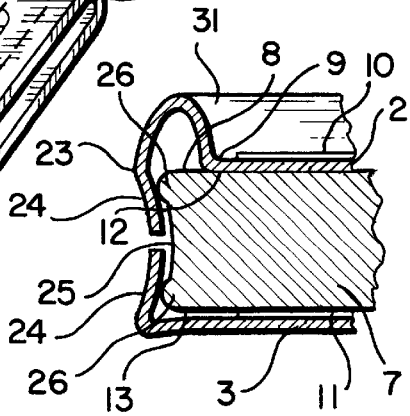

To prevent for example articles which can roll off easily from falling off or liquid or granular masses, such as sugar or the like, from flowing off, at least upper plate 2 is provided with a preferably peripheral elevation 31 as shown by the broken lines in FIG. 2 and by solid lines in FIGS. 3 and 5. Advantageously only the surface of plate 2 surrounded by elevation 31 is provided in whole or in part with antislip coating 10 or is made antislip in some other way. When used for a folding table however either there is no elevation 31 or it has only a small height of for example roughly 1 mm to 3 mm, since in the folded-up state there is often not enough free space between the folded-up table surfaces and a wall or rear wall of a front seatback or the like.

Figure 4:
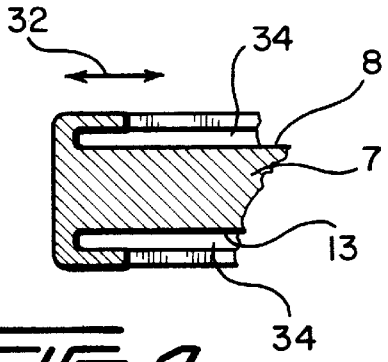

According to one advantageous embodiment of the invention the support can also be held by plates 2 and/or 3 having at least on the two opposite sides of plates 2,3 which form front sides 17 and 19 of support 6 one edge 33 which runs in the direction or roughly in the direction of plate plane 32 or corresponding sections which can be inserted into appropriately shaped insertion grooves 34 or insertion groove sections of table top 7 which have been formed accordingly (compare FIG. 4).

Support 6 can also be made of a molding manufactured in a U-shape, such as a plastic molding or injection molding, for which elevation 31, retaining means 24 and closing parts 20, 22 can be likewise molded thereto.

Support 6 as claimed in the invention can be used for table tops 7 of any type, even if it is especially advantageous for folding tables.

What is claimed is:

1. A covering for a table top, said covering comprising:

a top plate adapted to at least partially cover at least substantially 60% of an upper side of said table top, said top plate having an antislip outer surface for resisting slippage of articles placed thereon; and a bottom plate adapted to at least partially cover at least substantially 60% of a lower side of said table top, said bottom plate being pivotably mounted to said top plate and having an advertising outside surface for displaying of an advertisement:

wherein said advertising outside surface of said bottom plate is transparent to allow visual inspection of advertising material located underneath said advertising outside surface.

2. A cover of claim 1, further comprising a closure means on an edge surface of at least one of said top plate and said bottom plate for securing said top plate and said bottom plate together on said upper side and said lower side of said table top respectively.

3. A cover of claim 2, wherein said closure means includes a retaining means which projects toward the table top and secures said cover on the table top along an edge of said table top.

4. A cover of claim 3, wherein said retaining means secures said cover on the table top by frictionally engaging catch projections provided on said edge of said table top.

5. A cover of claim 2, wherein said closure means includes a clip provided on an edge of at least one of said top plate and said bottom plate, and a button provided on an opposite edge of the other of said at least one of said top plate and said bottom plate, said clip including an opening for engaging said button.

6. A cover of claim 2, wherein said antislip outer surface of said top plate is transparent to allow visual inspection of the advertising material located underneath said antislip outer surface.

7. A cover of claim 6, wherein said advertising outside surface of said bottom plate is transparent to allow visual inspection of advertising material underneath said advertising outside surface.

8. A cover of claim 1, wherein said bottom plate is pivotably mounted to said top plate by a hinge.

9. A cover of claim 8, wherein said hinge is formed by reducing a thickness of a linear area joining said bottom plate and said top plate.

10. A cover of claim 1, wherein said cover is a deep-drawn part made of at least one of metal, paper and plastic adapted to be folded into a U shape.

11. A cover of claim 1, wherein said cover is of a molded plastic.

12. A covering for a table top, said covering comprising:

a top plate adapted to at least partially cover at least substantially 60% of an upper side of said table top, said top plate having an antislip outer surface for resisting slippage of articles placed thereon; and a bottom plate adapted to at least partially cover at least substantially 60% of a lower side of said table top, said bottom plate being pivotably mounted to said top plate and having an advertising outside surface for displaying of an advertisement: wherein said advertising outside surface of said bottom plate includes braille text that allows reading by a visually impaired person.

13. A covering for a table top, said covering comprising:

a top plate adapted to at least partially cover at least substantially 60% of an upper side of said table top, said top plate having an antislip outer surface for resisting slippage of articles placed thereon; and a bottom plate adapted to at least partially cover at least substantially 60% of a lower side of said table top, said bottom plate being pivotably mounted to said top plate and having an advertising outside surface for displaying of an advertisement:

wherein said top plate further includes a peripheral elevation which projects upwardly from said top plate.

14. A cover of claim 13, wherein said peripheral elevation surrounds said antislip outer surface of said top plate.

15. A cover of claim 14, wherein said antislip outer surface of said top plate is transparent to allow visual inspection of advertising material located underneath said antislip outer surface.

16. A cover of claim 15, wherein said top plate is transparent to allow visual inspection of advertising material located underneath said top plate.

17. A covering for a table top, said covering comprising:

a top plate adapted to at least partially cover at least substantially 60% of an upper side of said table top, said top plate having an antislip outer surface for resisting slippage of articles placed thereon; and a bottom plate adapted to at least partially cover at least substantially 60% of a lower side of said table top, said bottom plate being pivotably mounted to said top plate and having an advertising outside surface for displaying of an advertisement:

wherein said top plate and said bottom plate each include a peripheral edge adapted to be inserted into peripheral insertion grooves of said table top for securing said top plate and said bottom plate together on said table top.

18. A covering for a table top, said covering comprising:

a top plate adapted to at least partially cover at least substantially 60% of an upper side of said table top, said top plate having an antislip outer surface for resisting slippage of articles placed thereon;

a bottom plate adapted to at least partially cover at least substantially 60% of a lower side of said table top, said bottom plate being pivotably mounted to said top plate and having an advertising outside surface for displaying of an advertisement; and a closure means on an edge surface of at least one of said top plate and said bottom plate for securing said top plate and said bottom plate together on said upper side and said lower side of said table top respectively;

wherein said antislip outer surface of said top plate is transparent to allow visual inspection of the advertising material located underneath said antislip outer surface; and wherein said top plate further includes a peripheral elevation which projects upwardly from said top plate and surrounds said antislip outer surface of said top plate.

* * * * *